United States Patent [19]

Yasumochi et al.

[11] 4,172,030

[45] Oct. 23, 1979

[54] NON-MAGNETIC METAL SELECTING METHOD AND APPARATUS

[75] Inventors: Ryutaro Yasumochi; Toshiharu Watanabe, both of Kawasaki, Japan

[73] Assignee: Fuji Electric Co., Ltd., Kawasaki, Japan

[21] Appl. No.: 843,914

[22] Filed: Oct. 20, 1977

[30] Foreign Application Priority Data

Oct. 21, 1976 [JP] Japan ..... 51-126470

[51] Int. Cl.[2] ..... B03C 1/10

[52] U.S. Cl. ..... 209/212; 209/223 R; 209/225

[58] Field of Search ..... 209/214, 215, 212, 226, 209/227, 213, 223 R, 225; 366/273

[56] References Cited

U.S. PATENT DOCUMENTS

| | | | |
|---|---|---|---|
| 1,083,979 | 1/1914 | Zander | 209/227 |
| 1,414,170 | 4/1922 | Bethke | 209/226 |
| 1,417,189 | 5/1922 | McCarthy | 209/215 X |
| 3,659,311 | 5/1972 | Waren | 209/215 X |
| 4,046,679 | 9/1977 | Schloemann | 209/212 |

FOREIGN PATENT DOCUMENTS

| | | | |
|---|---|---|---|
| 26590 | 5/1930 | Australia | 209/212 |
| 297585 | 4/1915 | Fed. Rep. of Germany | 209/227 |
| 702729 | 1/1954 | United Kingdom | 209/227 |
| 824043 | 12/1959 | United Kingdom | 209/227 |
| 125206 | 3/1959 | U.S.S.R. | 209/227 |

*Primary Examiner*—Robert Halper

*Attorney, Agent, or Firm*—Sughrue, Rothwell, Mion, Zinn and Macpeak

[57] ABSTRACT

Non-magnetic metal particles are separated from a mixture by an inclined rotating electrically insulating drum and the action of travelling electromagnetic field. The mixture is introduced at the upper end of the inclined drum which is supported by a rotary iron core through support rods. The rotary iron core and drum are rotated in one direction. Simultaneously, a shifting electromagnetic field is generated along the lower part of the outer periphery of the drum in a direction opposite to the direction of rotation of the drum. As a result, the mixture as it travels through the drum is repeatedly brought upwardly in the direction of drum rotation along the inner surface of the drum due to the frictional force between the mixture and the drum inner surface or upwardly in the direction of the shifting electromagnetic field and then tumbled down onto the bottom of the drum. This process provides a completed stirring of the mixture and promotes the separation of the non-magnetic metal particles irrespective of relative particle sizes.

4 Claims, 5 Drawing Figures

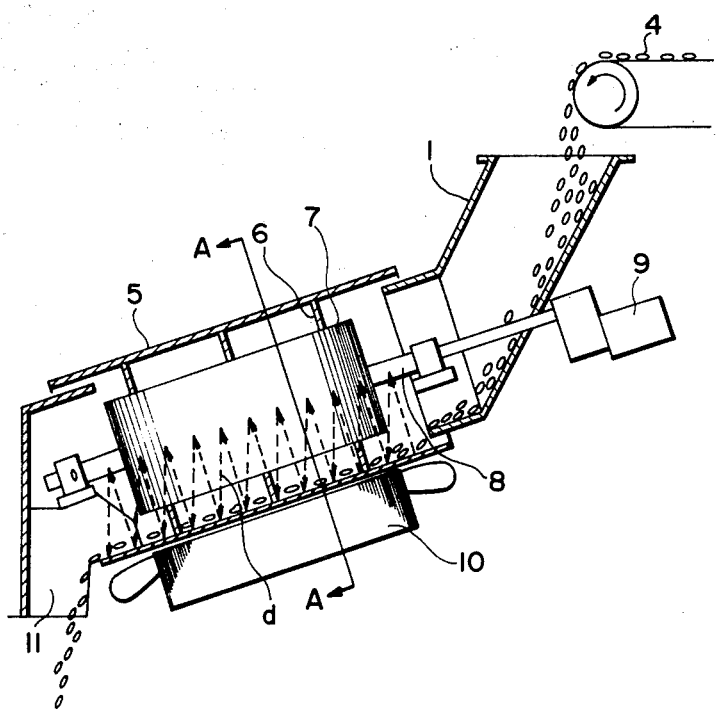

NON-MAGNETIC METAL SELECTING METHOD AND APPARATUS

BACKGROUND OF THE INVENTION

The invention relates to a non-magnetic metal sorting method and apparatus using a shifting magnetic field to select non-magnetic metals from a mixture including them.

A shifting electromagnetic field has been utilized to separate and select non-magnetic metals from a mixture having its iron component removed by means of magnets for the purpose of resource recovery from solid waste. For this purpose, there have been proposed in the art several apparatuses schematically shown in FIGS. 1 through 3. One example is shown in FIG. 1 in which a shifting electromagnetic field generator is utilized to produce an electromagnetic force acting in the direction indicated by the arrow a on the mixture including non-magnetic metal particles supplied from a chute 1 and transported by means of a belt conveyer 2 so that the non-magnetic metal particles are moved in the direction indicated by the arrow b and the remainder of the mixture is moved in the direction indicated by the arrow c. The apparatus shown in FIG. 2 includes a shifting electromagnetic field generator 3 to produce an electromagentic force in the direction indicated by the arrow a so that the non-magnetic metal particles are accelerated in the same direction as the direction of travel of the belt conveyer 2 and discharged in a position far away from the belt conveyer 2 as indicated by the arrow b while the remainder of the mixture is discharged in a position near the belt conveyer 2 as indicated by the arrow c. In the FIG. 3 apparatuses, a shifting electromagnetic field generator 3 is used to produce an electromagnetic force exerted in a direction opposite to the direction of travel of the belt conveyer 2 so that the non-magnetic metal particles are discharged as shown by the arrow b and the remainder of the mixture is discharged as shown by the arrow c.

Such conventional non-magnetic metal separating apparatus generally provide a satisfactory separation of non-magnetic metal particles from the mixture, but where the non-magnetic metal particles have different size from the remainder of the mixture, the conventional apparatus do not perform well. Where the size of the non-magnetic metal particles is relatively smaller than that of the remainder, the non-magnetic metal particles will be held between the larger particles of the remainder and cannot be effectively separated therefrom by the electromagnetic force acting on the non-magnetic metal particles. On the contrary, where the size of the non-magnetic metal particles is relatively larger than that of the remainder, the non-magnetic metal particles will trap the smaller particles of the remainder.

SUMMARY OF THE INVENTION

Therefore, the invention has for its object to provide an apparatus capable of selecting non-magnetic metals from a mixture regardless of the relative size of the non-magnetic metal particles.

This object is attained in accordance with the present invention by introducing a mixture including non-magnetic metals through a chute into a rotary drum inclined at an angle with an arch-shaped shifting electromagnetic field generator covering the bottom outer surface of the drum to produce a shifting magnetic field in a direction opposite to the direction of rotation of the drum. As a result, the non-magnetic metals and the remainder of the mixture are fully stirred during the transportion of the mixture through the rotary drum thereby facilitating the selection of the non-magnetic metals from the mixture and providing an accurate selection of non-magnetic metals from the mixture.

DETAILED DESCRIPTION OF THE INVENTION

Figure 1:
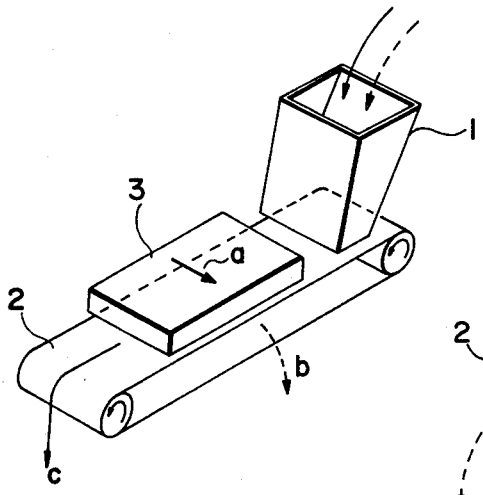
FIGS. 1 to 3 are perspective views showing conventional non-magnetic selecting apparatuses.
Figure 2:
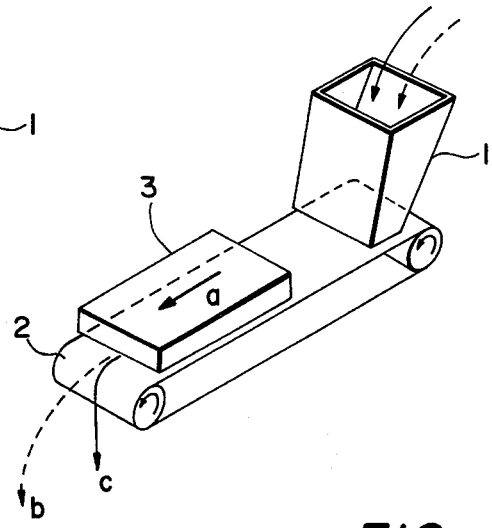
Figure 3:
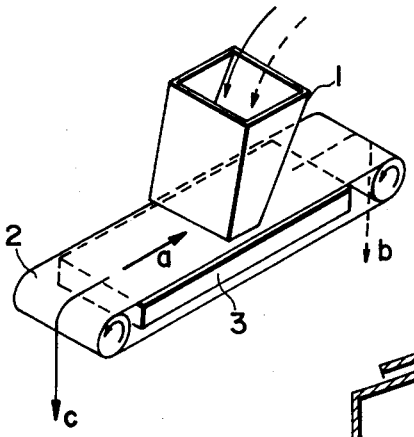
Figure 4:
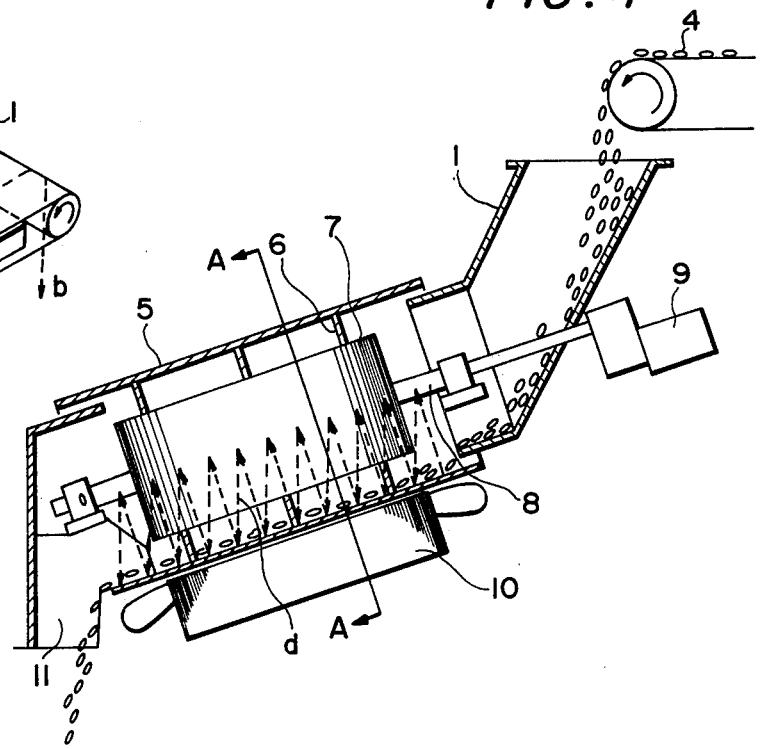
FIG. 4 is a sectional view showing one embodiment of a non-magnetic metal selecting apparatus according to the present invention.
Figure 5:
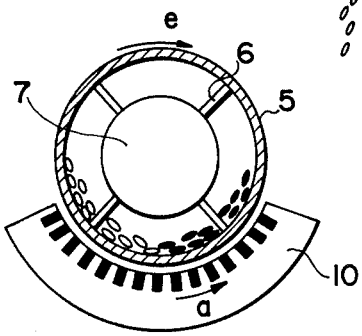
FIG. 5 is a sectional view taken along the line A—A of FIG. 4.

One embodiment of a non-magnetic metal selecting apparatus in accordance with the present invention will be described, by way of example, with reference to FIGS. 4 and 5. FIG. 4 shows one embodiment of a non-magnetic metal selecting apparatus in accordance with the present invention and FIG. 5 is a sectional view of the FIG. 4 embodiment taken along the line A—A. In FIG. 4, the mixture including non-magnetic metal particles transported on a belt conveyer 4 is supplied through a chute 1 into a rotary drum 5 made of an electrically insulating material. The drum 5 is supported through support rods 6 by an iron core 7 through which a rotary shaft 8 extends so that the drum 5 is rotated in the clockwise direction indicated by the arrow e in FIG. 5 as the rotary shaft 8 is rotated by drive means 9. The support rods 6 are preferably made in a cylindrical form and as slender as possible to permit the free movement of the mixture including non-magnetic metal particles. An arch-shaped shifting field generator 10 is disposed just under the lower side of the rotary drum 5 to cover $\frac{1}{3}$ to $\frac{1}{2}$ of the outer peripheral surface of the drum 5 for producing a shifting electromagnetic field in the counterclockwise direction indicated by the arrow a in FIG. 5 opposite to the direction of rotation of the drum 5. A separation plate 11 is provided at the downstream end of the rotary drum 5. The rotary drum 5 is inclined at an angle determined such that the mixture including non-magnetic metal particles does not pass by its weight through the rotary drum 5 in a short time, but travels therethrough with the mixture brought upwardly in the direction of arrow e along the inner surface of the drum 5 due to the frictional force between the mixture and the drum inner surface or upwardly in the direction of arrow a along the inner surface of the drum 5 due to the electromagnetic force produced by the shifting field generator and then falls by its weight thereby providing a complete stirring of the mixture within the drum so as to separate the non-magnetic metal particles from the mixture.

In operation, when a mixture including non-magnetic metal particles is supplied through the chute 1 into the rotary drum 5, the mixture other than the non-magnetic metal particles is lifted along the inner surface of the drum 5 while the frictional force between the mixture and the drum inner surface overcomes the weight thereof and then tumbles down onto the bottom of the rotary drum 5 and again is lifted up along the drum inner surface due to the frictional force. This is repeated so that the mixture other than the non-magnetic metal particles reaches the downstream end of the rotary drum 5 through the path indicated by the broken arrow d in FIG. 4. On the other hand, the non-magnetic metal particles are subject to the electromagnetic force produced by the shifting magnetic field generator 10 to move in the direction opposite to the direction of rotation of the cylindrical drum 5 because the electromagnetic force overcomes the frictional force between the non-magnetic metal particles and the drum inner surface.

Since the shifting magnetic field generator 10 is disposed to cover the lower part of the drum 5 as shown in FIG. 5, the part of the non-magnetic metal particles sent beyond the range in which the shifting electromagnetic field exists is returned to the range of the electromagnetic field due to the weight thereof, and the non-magnetic metal particles are again subject to the action of the electromagnetic force. This is repeated again and again until the non-magnetic metal particles reach the downstream end of the rotary drum 5. Accordingly, because the shifting magnetic field is directed as indicated by the arrow a and the rotary drum 5 is rotated in the direction as indicated by the arrow e in FIG. 5, the non-magnetic metal particles are separated to the right as indicated by the black particles and the remainder of the mixture is separated to the left as indicated by white particles at the downstream end of the drum 5.

The relatively small sized non-magnetic metal particles moved in the direction of rotation of the drum 5 together with the mixture having a large size are subject to the electromagnetic force to move in the direction of the shifting magnetic field when the mixture tumbles down due to the weight thereof. On the other hand, the relatively small sized remainder of the mixture moved together with large sized non-magnetic metal particles is separated from the non-magnetic metal particles when the non-magnetic metal particles are returned to the range in which the shifting field exists, to move in the direction of rotation of the drum 5 by the frictional force relative to the drum inner surface and the weight thereof. Accordingly, the selection as shown in FIG. 5 is effected regardless of the size of the non-magnetic metal particles.

At the downstream end of the rotary drum 5, the non-magnetic metal particles and the remainder of the mixture can separately fall down. The separation plate 11 in contact with the drum inner surface at the boundary between the non-magnetic metal particles and the remainder of the mixture is effective to separate them with certainty.

What is claimed is:

1. An apparatus for selecting non-magnetic metal particles from a mixture containing substantially no magnetic particles comprising an electrically insulating drum inclined at an angle, a rotary a rotary iron core supporting the drum through support rods, means connected to said rotary iron core for rotating said drum in a first direction, an arcuate-shaped shifting electromagnetic field generator disposed to cover the lower part of the outer periphery of the drum for generating a shifting electromagnetic field in a second direction opposite to said first direction of rotation of said drum, and means for supplying a mixture including non-magnetic metal particles to the elevated end of said drum.

2. A non-magnetic metal selecting apparatus as set forth in claim 1, which further comprises a separation plate provided at the downstream end of said drum in contact with the inner surface of the drum, said non-magnetic metal particles being separated to one side of said plate and the remainder of said mixture being separated to the other side of said plate.

3. A non-magnetic metal selecting apparatus as set forth in claim 1 wherein said drum is inclined at an angle such that said mixture including non-magnetic particles does not pass by its weight through said rotary drum in a short time, but travels therethrough with the mixture being repeatedly brought upwardly in said first direction along the inner surface of said drum due to the frictional force between said mixture and said drum inner surface or upwardly in said second direction along said drum inner surface due to said shifting electromagnetic field and then tumbling down onto the bottom of said drum, thereby providing a complete stirring of said mixture within said drum to promote the separation of said non-magnetic metal particles from the remainder of said mixture.

4. A method of selecting non-magnetic metal particles from a mixture containing said particles comprising the steps of introducing said mixture into the elevated end of an inclined electrically insulating drum, said drum being supported by a rotary iron core through support rods, rotating said rotary iron core and said drum in a first direction, simultaneously with said step of rotating, generating a shifting electromagnetic field along the lower part of the outer periphery of said drum in a second direction opposite to said first direction of rotation of said drum, said steps of rotating and generating causing said mixture as it travels through said drum to be repeatedly brought upwardly in said first direction along the inner surface of said drum due to the frictional force between said mixture and said drum inner surface or upwardly in said second direction along said drum inner surface due to said shifting electromagnetic field and then tumbled down onto the bottom of said drum, thereby providing a complete stirring of said mixture within said drum to promote the separation of said non-magnetic metal particles from the remainder of said mixture.

* * * * *